United States Patent [19]

Stadler

[11] 4,376,060

[45] Mar. 8, 1983

[54] PROCESS FOR PREPARING LITHIUM SOAP GREASES CONTAINING BORATE SALT WITH HIGH DROPPING POINT

[75] Inventor: James F. Stadler, Bethel Park, Pa.

[73] Assignee: Exxon Research and Engineering Co., Florham Park, N.J.

[21] Appl. No.: 318,204

[22] Filed: Nov. 4, 1981

[51] Int. Cl.[3] ..... C10M 1/20; C10M 1/54

[52] U.S. Cl. ..... 252/42.1; 252/18; 252/25

[58] Field of Search ..... 252/42.1, 18, 25

[56] References Cited

U.S. PATENT DOCUMENTS

| | | | |
|---|---|---|---|
| 2,815,325 | 12/1957 | Pohorilla et al. | 252/42.1 |
| 2,940,930 | 6/1960 | Pattenden et al. | 252/39 |
| 2,958,659 | 11/1960 | Brown | 252/42.1 |
| 3,223,624 | 12/1965 | Morway et al. | 252/18 |
| 3,223,633 | 12/1965 | Morway et al. | 252/40 |
| 3,681,242 | 8/1972 | Gilani et al. | 252/41 |
| 3,758,407 | 9/1973 | Harting | 252/18 |
| 3,791,973 | 2/1974 | Gilani et al. | 252/41 |
| 3,929,651 | 12/1975 | Murray et al. | 252/41 |
| 3,985,662 | 10/1976 | Campbell et al. | 252/41 |
| 4,138,348 | 2/1979 | Grasshoff | 252/42.1 |

*Primary Examiner*—Jacqueline V. Howard
*Attorney, Agent, or Firm*—Eugene Zagarella, Jr.

[57] ABSTRACT

This invention relates to a process of preparing a high dropping point grease comprising a combination of a selected lithium soap of hydroxy fatty acid and a lithium salt of boric acid wherein said lithium salt of boric acid is formed in situ in the presence of an additive amount of selected water soluble polyhydroxy compound.

10 Claims, No Drawings

PROCESS FOR PREPARING LITHIUM SOAP GREASES CONTAINING BORATE SALT WITH HIGH DROPPING POINT

BACKGROUND OF THE INVENTION

This invention relates to an improved process for producing lithium soap greases containing a borate salt and having a high dropping point.

Lithium greases have been known and widely used for many years. The lithium soaps that are used as thickening agents for these greases are ordinarily prepared by the reaction of lithium hydroxide or other suitable lithium base with a conventional high molecular weight acid or acids. The principal advantages of lithium greases have been high water resistance and ease of dispersion of the soaps in all types of lubricating oil base stocks. Particularly useful have been greases prepared from lithium hydroxystearate, since the soaps of the hydroxystearic acids and related hydroxy fatty acids have been found to be more mechanically stable than the corresponding soaps of the conventional fatty acids.

There are many fields of application for grease compositions where a high dropping point is required, as for example, in the lubrication of traction motor bearings. The bearings of these locomotives may be required to operate for periods of as much as three years without any maintenance, and temperatures as high as 250° F. (121° C.) can be reached in such bearings. Other applications require even higher dropping points in the grease composition.

Several teachings exist for preparing high dropping point greases e.g. U.S. Pat. No. 2,940,930 where mixtures of monocarboxylic and dicarboxylic acids are used. U.S. Pat. Nos. 3,223,633 and 3,223,624 teach the preparation of high dropping point greases from a three component mixture of acids. U.S. Pat. No. 3,681,242 discloses a particular method of preparing lithium soap greases containing a dilithium soap of a dicarboxylic and wherein a two stage heating operation is used. U.S. Pat. No. 3,985,662 discloses a high dropping point grease derived from a lithium soap of a fatty acid which contains an epoxy group and/or ethylenic unsaturation.

U.S. Pat. No. 3,758,407 discloses a high dropping point lithium soap grease which comprises a lithium soap of $C_{12}$ to $C_{24}$ hydroxy fatty acid and a monolithium salt of boric acid.

Despite all the noted disclosures of high dropping point greases there still is the need for improved compositions and/or processes for developing greases with increased high dropping points.

SUMMARY OF THE INVENTION

Now in accordance with the process of this invention a lithium soap grease with significantly improved dropping point is developed. More particularly, this invention involves a process for preparing lubricating greases of high dropping point wherein the grease thickener comprises a combination of lithium soap of $C_{12}$ to $C_{24}$ hydroxy fatty acid and a monolithium salt of boric acid and wherein an effective amount of selected water soluble polyhydroxy compound is added in situ when forming the lithium borate salt.

DETAILED DESCRIPTION OF THE INVENTION

This invention relates to a process for preparing high dropping point lithium soap greases comprising a combination of a selected lithium soap of hydroxy fatty acid and a monolithium salt of boric acid wherein an effective additive amount of selected water soluble polyhydroxy compound is added to the system when forming the lithium borate salt. The lithium complex greases prepared by this invention are of the general type disclosed in U.S. Pat. No. 3,758,407. However, by using the particular process of manufacture as disclosed herein, the resulting greases have significantly improved dropping points.

The hydroxy fatty acid employed in preparing the greases in accordance with this invention will have about 12 to 24 or more usually about 16 to 20 carbon atoms and will preferably be a hydroxystearic e.g. 9-hydroxy, 10-hydroxy, or 12-hydroxystearic acid, more preferably the latter. Ricinoleic acid, which is an unsaturated form of 12-hydroxystearic acid, having a double bond in the 9–10 position, can also be used. Other hydroxy fatty acids include 12-hydroxybehenic acid and 10-hydroxypalmitic acid.

A second hydroxycarboxylic acid can be used along with the boric acid and hydroxy fatty acid and it will be one having an OH group attached to a carbon atom that is not more than 6 carbon atoms removed from the carboxyl group. This acid has from 3 to 14 carbon atoms and can be either an aliphatic acid such as lactic acid, 6-hydroxydecanoic acid, 3-hydroxybutanoic acid, 1-hydroxycaproic acid, 4-hydroxybutanoic acid, 6-hydroxyalphahydroxystearic acid, etc. or an aromatic acid such as parahydroxybenzoic acid, salicylic acid, 2-hydroxy-4-hexylbenzoic acid, metahydroxybenzoic acid, 2,5-dihydroxybenzoic acid (gentisic acid); 2,6-dihydroxybenzoic acid (gamma resorcylic acid); 4-hydroxy-4-methoxybenzoic acid, etc. or a hydroxyaromatic aliphatic acid such as orthohydroxyphenyl, metahydroxyphenyl, or parahydroxyphenyl acetic acid. A cycloaliphatic hydroxy acid such as hydroxycyclopentyl carboxylic acid or hydroxynaphthenic acid could also be used. Particularly useful hydroxy acids are lactic acid, salicyclic acid, and parahydroxybenzoic acid.

In place of the free hydroxy acid of the latter type when preparing the grease, one can use a lower alcohol ester, e.g., the methyl, ethyl, or propyl, isopropyl, or sec-butyl ester of the acid, e.g., methyl salicylate, to give a better dispersion when the salt is insoluble. The amount of lithium salt of the hydroxy acid will range from about 0.1 to about 10 wt. percent of the finished grease, or preferably from about 0.2 to about 5 wt. percent. The monolithium salt or the dilithium salt of the second hydroxy acid can be used, but the dilithium salt is preferred.

The lithium salt of boric acid is generally formed by neutralizing a lithium base, generally lithium hydroxide with boric acid in aqueous system. The essential feature of this invention is that this lithium borate salt is formed in situ in the presence of selected polyhdroxy compound. By so forming the borate, the resulting grease exhibits a surprisingly improved dropping point.

The polyhydroxy compounds used in the process of this invention will be selected water soluble alcohol and phenol compounds and more particularly water soluble dihydric and polyhydric alcohols and phenols of the cis form. The preferred polyhydroxy compounds will contain up to 7 carbon atoms and will be either dihydric (diol) or trihydric (triol). Compounds of this type include the aliphatic and cycloaliphatic alcohols, which may be saturated or unsaturated, branched or unbranched. Illustrative compounds of this type include glycerol; 1,2 and 1,3 cyclopentanediol; 0-quinols and mannitol. Glycerol is the particularly preferred polyhydroxy compound used in this invention. In selecting a polyhydroxy compound, it is desirable that it be capable of forming a complex with boric acid and help increase the strength of such boric acid.

The amount of polyhdroxy compound used in this process will generally be an effective amount to make the boric acid more reactive and form more lithium borate. More particularly, the amount of polyhydroxy compound used will vary from about 0.1 to 1 wt% and preferably from about 0.25 to 0.5%, based on the total weight of the composition.

The total soap and salt content of the grease will be in the range of from about 2 to 30 wt. percent and preferably about 5 to 20 wt. percent. The proportion of the $C_{12}$ to $C_{24}$ hydroxy fatty acid to boric acid will be in the range of a weight ratio of about 3 to 100 parts, or more usually about 5 to 80 parts, of hydroxy fatty acid per part by weight of boric acid. There will be a weight ratio of about 0.1 to 10, or more usually about 0.5 to about 5 parts of said second hydroxycarboxylic acid per part by weight of boric acid in the case of the greases made from 3 acid components.

The lubricating oil base that is used in preparing the grease compositions of this invention can be any of the conventionally used mineral oils, synthetic hydrocarbon oils, or synthetic ester oils, and will generally have a viscosity within the range of about 35 to 200 SUS at 210° F. (99° C.). Synthetic lubricating oils that can be used include esters of dibasic acids such as di-2-ethylhexyl sebacate, esters of glycols such as the $C_{13}$ oxo acid diester of tetraethylene glycol, or complex esters such as a complex ester formed by reacting 1 mole of sebacic acid with 2 moles of tetraethylene glycol and 2 moles of 2-ethylhexanoic acid. Other synthetic oils that can be used include synthetic hydrocarbons such as alkyl benzenes, e.g., alkylate bottoms from the alkylation of benzene with tetrapropylene, or the copolymers of ethylene and propylene; silicone oils, e.g., ethylphenyl polysiloxanes, methyl polysiloxanes, etc., polyglycol oils, e.g., those obtained by condensing butyl alcohol with propylene oxide; carbonate esters, e.g., the product of reacting $C_8$ oxo alcohol with ethyl carbonate to form a half ester followed by reaction of the latter with tetraethylene glycol etc. Other suitable synthetic oils include the polyphenyl ethers, e.g., those having from about 3 to 7 ether linkages and about 4 to 8 phenyl groups. (See U.S. Pat. No. 3,424,678, column 3.)

The following examples are further illustrative of this invention and are not intended to be construed is limitations thereof.

EXAMPLE I

A lithium complex soap grease was prepared using as the thickener system a combination of lithium 12-hydroxystearate and monolithium borate. The base oil (433.1 g) used in preparing the grease was a solvent refined Mid-Continent lubricating oil distillate known as Solvent 450 Neutral having a viscosity of 450 SUS at 100° F. (38° C.). The 12-hydroxystearic acid (50 g) was added to a portion of the base oil (about ½ of the total oil used in the complete grease) and the mixture was heated to a temperature sufficiently high to melt the 12-hydroxystearic acid, this temperature being about 180° F. to 190° F. (82° to 88° C.). Then the boric acid (8.30 g) and lithium hydroxide monohydrate (12.6 g) were added as an aqueous solution in the presence of 0.20% by weight glycerol. The resulting mixture was stirred and heated to a final temperature of about 380° to 390° F. (193° to 199° C.). The remaining portion of base oil was added and the mixture was cooled to ambient temperature and milled in a conventional grease mill.

The resulting grease had desirable consistency and a dropping point of 502° F.

Similar grease formulations were prepared using the same process and components with 0.20; 0.25; 0.50 and 0.20% by weight of glycerol in the respective runs. The resulting greases had good consistency and respective dropping points of 524° F., 533° F., 600+° F. and 501° F.

EXAMPLE II

As a comparison, four grease formulations were prepared in the same manner and with the same components and amounts as defined above except for the absence of glycerol.

The four greases prepared had dropping points of 442° F., 427° F., 425° F. and 436° F., all significantly below those prepared in Example I in accordance with the process of this invention.

What is claimed is:

1. In a process of preparing a lithium soap grease composition of high dropping point comprising a major portion of lubricating oil and a thickener system whose essential components include a lithium soap of $C_{12}$ to $C_{24}$ hydroxy fatty acid and a lithium salt of boric acid the improvement wherein the lithium salt of boric acid is formed in situ in the presence of an effective additive amount of water soluble polyhydroxy alcohol or phenol.

2. The process of claim 1 wherein said polyhydroxy compound is present in an amount of from about 0.1 to about 1 wt%, based on the total weight of the grease composition.

3. The process of claim 2 wherein said polyhydroxy compound is a dihydric or polyhydric alcohol or phenol of the cis form.

4. The process of claim 3 wherein from about 2 to 30 wt% of said thickener system is present.

5. The process of claim 4 wherein said polyhydroxy compound is glycerol.

6. The process of claim 5 wherein the thickener system includes as a third component a lithium salt of a second hydroxy carboxylic acid of from 3 to 14 carbon atoms, wherein the hydroxy group is attached to a carbon atom not more than 6 carbon atoms removed from the carboxy group.

7. The process of claim 6 wherein there are about 3 to about 100 parts by weight of hydroxy fatty acid per part by weight of boric acid and from about 0.1 to about 10 parts of said second hydroxy carboxylic acid per part of boric acid.

8. The process of claim 5 wherein said hydroxy fatty acid is 12-hydroxystearic acid.

9. The process of claim 6 wherein said hydroxy fatty acid is 12-hydroxystearic acid and said second hydroxycarboxylic acid is salicyclic acid.

10. The process of claim 9 wherein from about 0.25 to about 0.5 wt.% of said glycerol is used.

* * * * *